United States Patent [19]

Ribitsch et al.

[11] Patent Number: 5,049,081

[45] Date of Patent: Sep. 17, 1991

[54] LOW-VOLTAGE LIGHTING FIXTURE

[76] Inventors: Kurt Ribitsch, Dachsbergweg 4b, A-4400 Steyr; Andreas Zoufal, Stelzerstrasse 35, A-4020 Linz, both of Austria

[21] Appl. No.: 392,981

[22] PCT Filed: Nov. 4, 1988

[86] PCT No.: PCT/AT88/00088

§ 371 Date: Aug. 25, 1989

§ 102(e) Date: Aug. 25, 1989

[87] PCT Pub. No.: WO89/04437

PCT Pub. Date: May 18, 1989

[30] Foreign Application Priority Data

Nov. 4, 1987 [AT] Austria ..... 2908/87

[51] Int. Cl.[5] ..... H01R 39/00

[52] U.S. Cl. ..... 439/10; 439/13; 362/250; 362/407; 362/419

[58] Field of Search ..... 439/10, 11, 13; 362/427, 407, 419, 250, 391, 404, 147

[56] References Cited

U.S. PATENT DOCUMENTS 4,449,172 5/1984 Warshawsky ..... 362/427

4,802,074 1/1989 Puschkarski ..... 439/11

*Primary Examiner*—Carroll B. Dority

*Attorney, Agent, or Firm*—Kurt Kelman

[57] ABSTRACT

A low-voltage lighting fixture comprises a pair of parallel electrical conductor rails, and an electrical current collector shoe slidingly mounted on the conductor rails. The collector shoe comprises a pair of collector heads slidingly mounted on the rails and a socket carrier electrically conductively connected to the collector heads and comprised of two electrically conductive socket sections electrically insulated from each other by an insulating element positioned between the socket sections. The socket carrier is mounted between the collector heads for rotation about an axis extending perpendicularly to the rails, and there is a socket for a lamp on the socket carrier.

8 Claims, 2 Drawing Sheets

LOW-VOLTAGE LIGHTING FIXTURE

Figure 1:
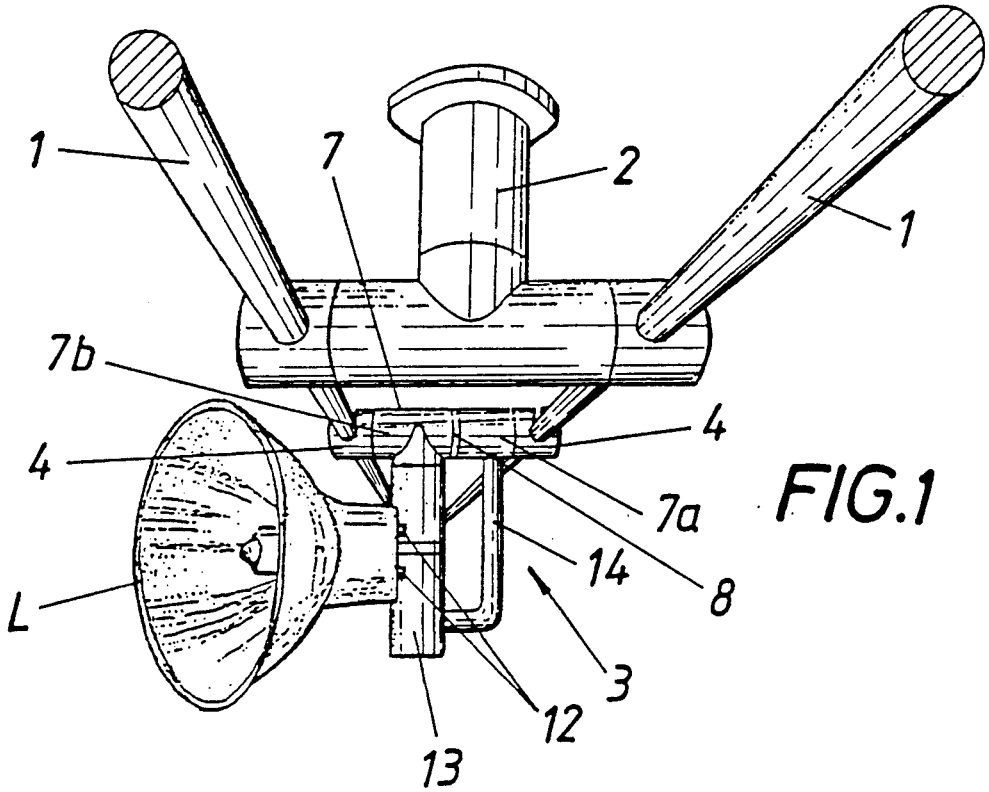

The invention concerns a low-voltage lighting fixture, consisting of a pair of parallel conductor rails and a collector shoe which can slide along the conductor rails and has an insulating feature to prevent current from flowing between the two conductor rails, and a swiveling holder for a lamp socket or similar device which is electrically connected to the two sliding shoe sections that are electrically separated from each other by the insulating feature.

As described by EP-A1 0 171 126, such a low-voltage lighting fixture already exists in connection with a suspension device for pictures etc., where two swivel arms which are insulated from each other are joined to a rigid sliding collector shoe and carry a swiveling lamp housing between their free ends. The swivel arms serve as an electrically conducting connection between the individual conductor rails and the lamp housing. Consequently, the design of this lighting fixture is relatively large and bulky. Morever, it permits swiveling of the light source only around an axis at right angles to the collector shoe guides, and also gives rise to frequent contact problems in the hinging areas between the sliding shoe and the swivel arms, or between the swivel arms and the lamp socket located inside the lamp housing.

Also, a low-voltage lighting fixture has been proposed according to DE-A-3 151 996 that features a block-shaped collector shoe which can slide along the pair of conductor rails and has a receiving trough and a magnet to receive a lamp with a ball-shaped housing. In this case, the electrical connection between the sliding collector shoe and the lamp must be provided by a separate cable, and the attachment of the lamp by means of magnetic forces remains rather uncertain due to the electromagnetic fields caused by the frequently high currents of low-voltage installations. Moreover, the available range of illumination is quite limited due to the collector block itself, in spite of the fact that the ball-shaped housing can swivel freely inside the receiving trough.

Therefore, this invention aims to eliminate these drawbacks by creating a low-voltage lighting fixture of the type described in the introduction, which stands out due to its space-saving, compact design, its robustness and functional reliability, and above all due to its ability to swivel freely as well as its all-round illumination range.

The invention achieves this objective by providing a sliding collector shoe consisting of two collector heads located on the rails and a lamp socket carrier situated between the collector heads which can swivel about an axis at right angles to the direction of the collector shoe guides. The lamp socket carrier is electrically connected to the collector heads in an articulated manner, is subdivided by means of an insulating intermediate element, and also is intended to form a carrier and electrical connection for the lamp socket. The lamp socket, or the lamp itself, is therefore mounted directly on the freely rotating center part of the socket carrier which forms the sliding collector shoe, and thus can be swiveled as desired between the collector heads. No separate swiveling arms and no cable connections are required, and a compact, sturdy lighting fixture is created in the smallest possible space.

In order to add another dimension to the swiveling range of the lamp socket, a particularly advantageous form of implementation of the invention provides the socket carrier holding the lamp socket with a carrier arm which is mounted between one of the socket carrier sections and a mounting bracket electrically connected to the other socket carrier section and can swivel about an axis at right angles to the rotating axis of the socket carrier. The carrier arm, which is supported at both ends in an electrically conducting manner, is divided by an insulating spacer just like the socket carrier, and in turn will carry the lamp socket. The result is a conductive universal joint that acts as a lamp socket holder, so that the lamp can be pointed in any direction and a practically unlimited area of illumination is achieved. Notwithstanding the ability to swivel freely, space requirements remain minimal, and the self-conducting carrier and arm elements provide a cableless electrical connection to the conductor rails and assure troublefree operation over long periods.

If, as provided by the invention, the socket carrier and—if applicable—the carrier arm consist of two metal bushings which are plugged onto both sides of the disk-shaped intermediate element that forms plug-on tenons, a simple, economical design is achieved which is optimally suited to its insulating task on the one hand, and to its current-conducting task on the other hand.

It is also advantageous to have a lamp socket formed by a pair of plug-in pins whose pins are mounted on both sides of the intermediate element in the two sections of the socket carrier or carrier arm, since this results in a particularly economical, space-saving and sturdy lamp socket.

If the plug-in pins in this design protrude radially through the metal bushings into the plug-on tenons of the intermediate element, these plug-in pins can also serve to fix the intermediate element to the metal bushings, which further simplifies the structure.

In order to achieve a good, low-resistance connection between the parts that can be rotated with respect to each other, the socket carrier or the carrier arm can be rotatably attached by placing the metal bushings with a frontal bearing hole over a metal bearing pin fitted to the part that supports them, with spring-loading between the supporting part and a pin head by means of a metal spring. This leads to a kind of self-restraining rotatability of the socket carrier with respect to the collector heads, or of the carrier arm with respect to the socket carrier or its supporting bracket, which causes the lamp socket to remain securely positioned in any rotational position. Moreover, the spring-loading of the parts assures proper electrical contact.

Figure 2:
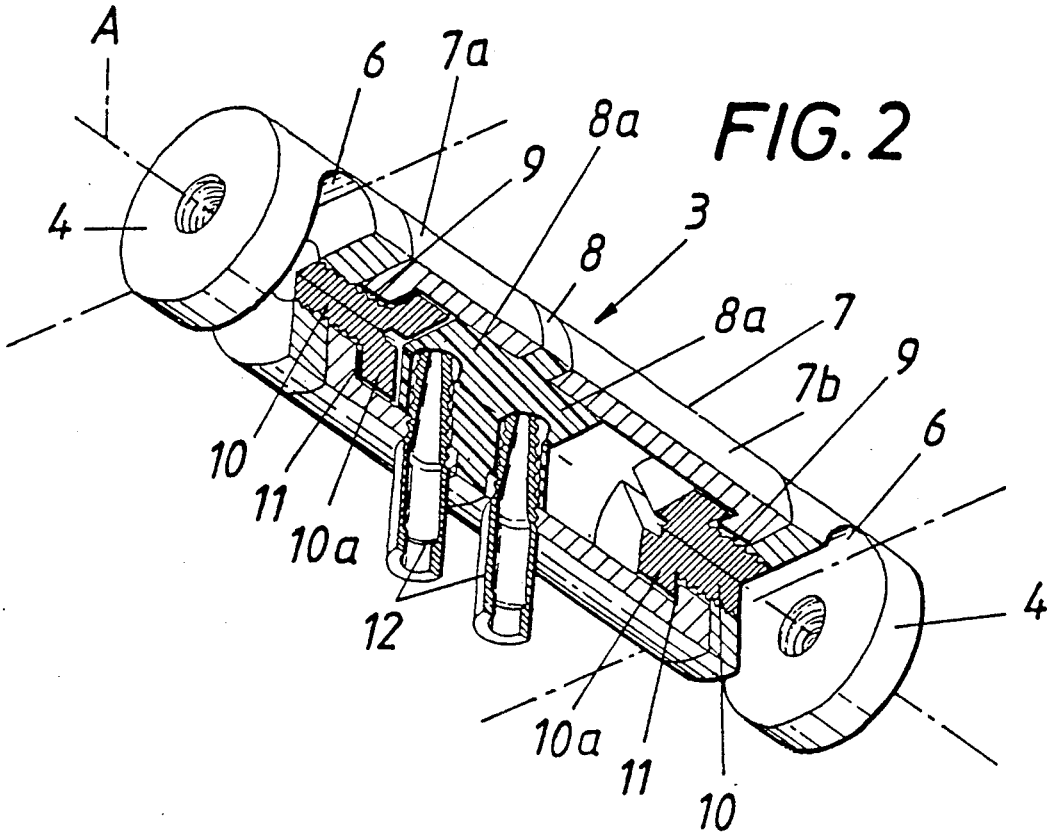
Figure 3:
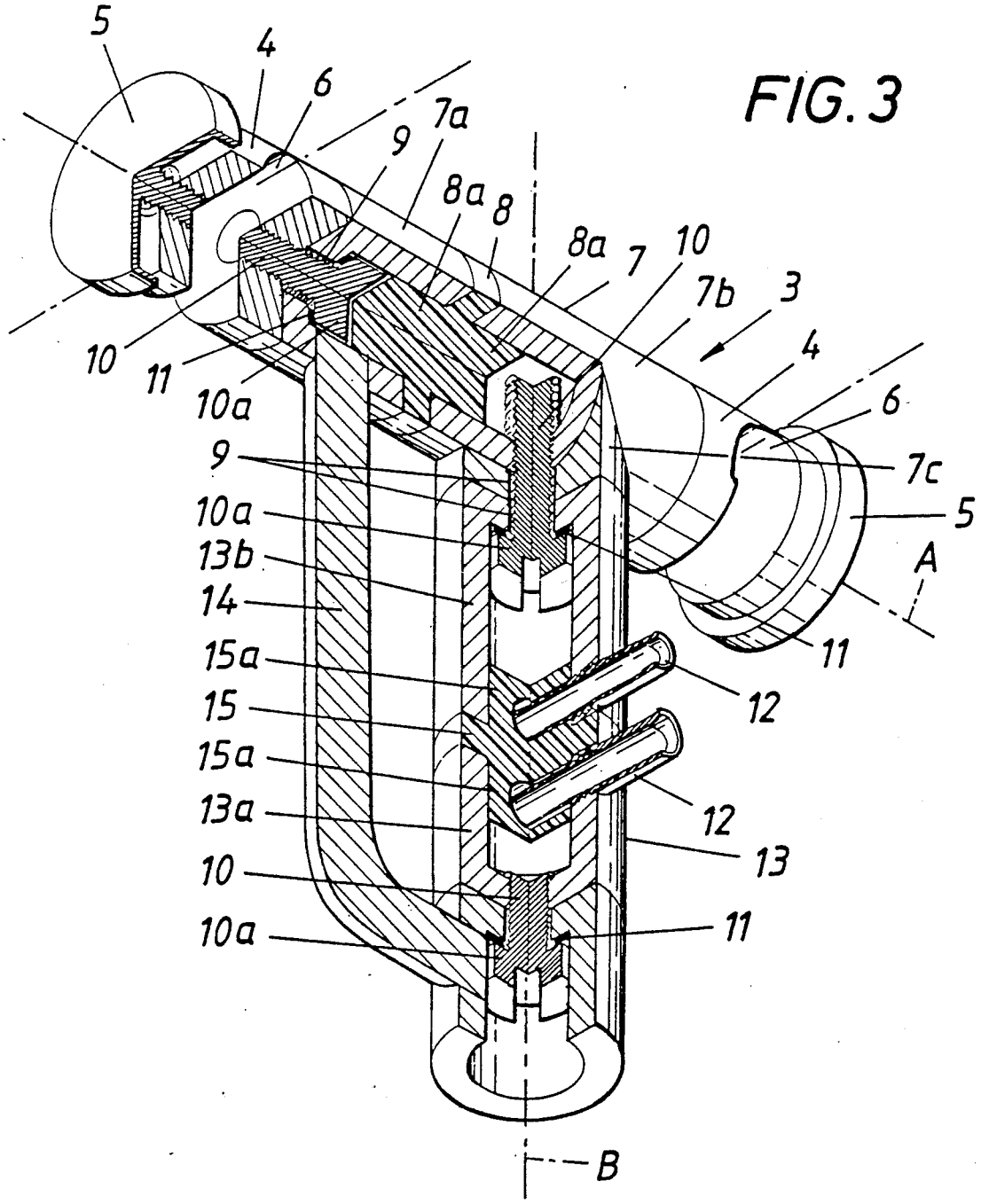

The drawing shows the object of the invention schematically, as follows:

FIG. 1 shows a perspective view of a low-voltage lighting fixture according to the invention, and FIGS. 2 and 3 show partial sections of two implemented examples of the sliding collector shoe of this lighting fixture at different scale factors.

On a pair of conductor rails 1, which is connected to a low-voltage power source in a manner not shown by the drawing and can be installed in parallel and insulated from one another in any desired position and direction by means of rail holders 2, a sliding collector shoe 3 is mounted which makes contact with the conductor rails 1 through collector heads 4 and can be fixed in any position along the rails by means of clamping screws 5 that penetrate into the slot- or hole-shaped guide openings 6 of the collector heads 4. Between the collector heads 4, the collector shoe 3 is fitted with a socket carrier 7 for the lamp socket of a low-voltage lamp L that can be rotated about a transverse axis A which runs at right angles with respect to the guide openings 6. The socket carrier is subdivided by an insulating intermediate element 8 and consists of two metal bushings 7*a*, 7*b* placed over the disk-shaped intermediate element which carries plug-on tenons 8*a* at opposite ends. For attaching the socket carrier 7 to the collector heads 4, each side is fitted with a bearing pin 10 that protrudes through a frontal bearing hole 9 of the metal bushings 7*a*, 7*b* and is seated in the adjoining collector head 4. A metal spring 11, confined between the bearing pin head 10*a* and the metal bushing 7*a*, 7*b* provides tension between the metal bushing 7*a*, 7*b* and the collector head 4. This creates a highly conductive, self-restraining, rotatable attachment of the socket carrier 7 to the collector heads 4.

As indicated in FIG. 2, the socket carrier 7 itself can now act as a support and socket for the low-voltage lamp L, with a pair of plug-in terminals 12 being fitted to the metal bushings 7*a*, 7*b* of the socket carrier 7 on either side of the intermediate element 8, the plug-in terminals 12 protruding through the metal bushings 7*a*, 7*b* and extending into the plug-on tenons 8*a* of the intermediate element 8 in order to secure the cohesion of the socket carrier 7. Since the plug-in terminals 12, due to their position in the metal bushings 7*a*, 7*b* connect directly to the two shoe sections, which are electrically separated by the intermediate element 8, the required power supply of a lamp L inserted into the plug-in terminals 12 is assured. By sliding the collector shoe 3 along the pair of conductor rails 1, this lamp can be positioned as desired and can be rotated to any direction around the transverse axis A by turning the socket carrier 7.

In order to achieve a wider swiveling range, the socket carrier 7 can be equipped with a carrier arm 13, as illustrated in FIG. 3, which is supported between one of the metal bushings 7*b*, or a saddle-shaped extension 7*c* of the socket carrier 7, and a holding bracket 14 attached to the other metal bushing 7*a* and can be rotated about an axis B at right angles to the transverse axis A, and consists of two metal bushings 13*a*, 13*b* and an insulating intermediate element 15, similar to the socket carrier 7. Here, as well, an electrically conductive, rotatable attachment is achieved by bearing pins 10 and springs 11 to tension the rotatable parts relative to each other. The pair of plug-in terminals 12 forms the lamp socket, with the plug-in terminals 12 again protruding into the interior of the metal bushings 13*a*, 13*b* and extending into the plug-on tenons 15*a* of the intermediate element 15. This results in a lighting fixture with a lamp which can not only be longitudinally positioned along the pair of rails 1 and can be swiveled about a transverse axis A, but can also be rotated about an axis B at right angles to A, so that in practice an all-round range of illumination becomes available.

What is claimed is:

1. A low-voltage lighting fixture comprising (a) a pair of parallel electrical conductor rails, and (b) an electrical current collector shoe slidingly mounted on the conductor rails, the collector shoe comprising (1) a pair of collector heads slidingly mounted on the rails, (2) a socket carrier electrically conductively connected to the collector heads and comprised of two electrically conductive socket carrier sections electrically insulated from each other by an insulating element positioned between the socket sections, (3) means for mounting the socket carrier between the collector heads for rotation about an axis extending perpendicularly to the rails, and (4) means forming a socket for a lamp on the socket carrier.

2. The low-voltage lighting fixture of claim 1, where in the means for forming a socket comprises a carrier arm, the carrier arm being comprised of two electrically conductive carrier arm sections electrically insulated from each other by an insulating element positioned between the carrier arm sections, and further comprising a holding bracket connected between one of the socket sections and the carrier arm, and means for mounting the carrier arm on the other socket section for rotation about an axis extending perpendicularly to the axis of rotation of the socket carrier.

3. The low-voltage lighting fixture of claim 2, wherein the socket carrier sections and carrier arm sections are metal bushings, and the insulating elements are disc-shaped insulations having plug-on tenons receiving the bushings.

4. The low-voltage lighting fixture of claim 3, wherein the means for mounting the socket carrier for rotation comprises respective metallic bearing pins passing through bearing holes in outer ends of the metal bushings and supporting the metal bushings on the collector heads, the bearing pins having heads, and a metallic spring between each bearing pin head and collector head clamping each metal bushing in position.

5. The low-voltage lighting fixture of claim 3, wherein the means for mounting the carrier arm for rotation comprises respective metallic bearing pins passing through bearing holes in outer ends of the metal bushings of the carrier arm section and supporting said metal bushings on the holding bracket and the other section, respectively, the bearing pins having heads, and a metallic spring between each bearing pin head and the other socket section and holding bracket, respectively, for clamping each metal bushing in position.

6. The low-voltage lighting fixture of claim 2, wherein the means forming a lamp socket is comprised of a pair of plug-in terminals, a respective one of the terminals being mounted on each carrier arm section adjacent the insulating element.

7. The low-voltage lighting fixture of claim 2, wherein the socket carrier sections and carrier arm sections are metal bushings, the insulating elements are disc-shaped insulations having plug-on tenons receiving the bushings, the means forming a lamp socket is comprised of said carrier arm including a pair of plug-in terminals, and a respective one of the terminals is mounted on each carrier arm section adjacent the insulating element and extends radially inwardly into the plug-on tenon of the adjacent insulating element.

8. The low-voltage lighting fixture of claim 1, wherein the means forming a lamp socket is comprised of a pair of plug-in terminals, a respective one of the terminals being mounted on each socket carrier section adjacent the insulating element.

* * * * *